US007131417B1

(12) United States Patent
Jones et al.

(10) Patent No.: US 7,131,417 B1
(45) Date of Patent: Nov. 7, 2006

(54) CYLINDER LINER PROVIDING COOLANT SHUNT FLOW

(75) Inventors: Jerry A. Jones, Ravenna, OH (US); Thomas F. Gazik, Parma, OH (US)

(73) Assignee: Alfred J. Buescher, Shaker Heights, OH (US)

( * ) Notice: Subject to any disclaimer, the term of this patent is extended or adjusted under 35 U.S.C. 154(b) by 0 days.

(21) Appl. No.: 11/255,414

(22) Filed: Oct. 20, 2005

(51) Int. Cl.
*F02F 1/00* (2006.01)
*F02F 1/10* (2006.01)

(52) U.S. Cl. ..... 123/193.2; 123/41.83

(58) Field of Classification Search ..... 123/193.2, 123/41.83, 41.84
See application file for complete search history.

(56) References Cited

U.S. PATENT DOCUMENTS 4,926,801 A 5/1990 Eisenberg et al.
5,299,538 A 4/1994 Kennedy

FOREIGN PATENT DOCUMENTS

GB 392091 5/1933
GB 1 525 766 9/1978

*Primary Examiner*—Tony M. Argenbright
*Assistant Examiner*—Katrina Harris
(74) *Attorney, Agent, or Firm*—Pearne & Gordon LLP

(57) ABSTRACT

A coolant-shunt-providing cylinder liner of the flanged type is provided with a shunt circuit within the liner for coolant flow through the liner. The shunt circuit includes an array of three annular cooling channels separated from each other by two annular ribs. The width (axial extent) of each channel is substantially less than half the axial extent of the liner's cylinder block engaging portion that is associated with the upper end of the liner. The width (axial extent) of the array of three channels is substantially greater than half the axial extent of the cylinder block engaging portion. Cutouts in the ribs are provided for distributing incoming coolant to the three cooling channels from a main coolant chamber of a cylinder block in which the liner is receivable.

4 Claims, 3 Drawing Sheets

CYLINDER LINER PROVIDING COOLANT SHUNT FLOW

This invention relates to diesel cycle internal combustion engines, and specifically to constructions of replaceable shunt-providing cylinder liners of the flange type.

BACKGROUND OF THE INVENTION

It is known to designers of cylinder liners that the highest temperatures occurring in a cylinder liner are near the top of the cylinder where the liner abuts the cylinder head, and where the exhaust gasses are driven from the cylinder head through the cylinder head exhaust valves. It is also known to provide annular cooling channels in the liners at these regions of greatest heating. Some examples of the prior art in this field may be briefly described as follows.

In United Kingdom patent 392,091 to Sulzer Freres, annular cooling channels 7–9 are provided in the upper engaging portion of the cylinder liner 1 where it engages and is supported by elements surrounding it including the jacket 5 and annular ring 21. Each of the channels 7–9 is substantially less than half the axial length (height) of the upper engaging portion of the liner. Coolant from the cooling chamber 14 passes in series up through the channels 9, 8 and 7 (in that order) and is exhausted through line 15. It is to be noted that the flow capacity of this cooling system is severely limited by the in-series (as distinguished from in-parallel) nature of the flow arrangement, the cross sectional flow area in the disclosed system approaching as little as a third of what it would be were the flow arrangement parallel in nature.

In United Kingdom patent 1,525,766 to Klockner-Humboldt, annular water jacket 14 and (in the FIG. 3 embodiment) annular water jacket 19, are both within the upper engaging portion of the cylinder liner, which extends down to the guide rib 13. Coolant enters water jacket 14 from below and flows in one or the other annular direction around the illustrated but un-numbered liner channel associated with annular water jacket 14 to exhaust passage 11. If annular water jacket 19 (shown in FIG. 3 of the patent) is also provided, flow occurs through its associated liner channel in the same manner. In each case, a first path of flow to exhaust occurs though a 90-degree angular distance, and the other or second path of flow occurs through angular distance of 270 degrees. In each case, the amount of cooling water that flows through the first path exceeds that flowing through the second path due to the difference in length, and therefore of flow resistance, of the two paths. The flow channel associated with water jacket 14 extends in axial length for a distance substantially greater than half the axial length (height) of the upper engaging portion of the liner, and the flow channel associated with water jacket extends in axial length for a distance substantially less than such height.

In U.S. Pat. No. 4,926,801 to Eisenberg et al. (Eisenberg), coolant flows in parallel through annular channels. The channels have an arcuate (rather than a predominately rectilinear) shape in cross-section, and are divided from each other by ribs whose radially outer extremities are the pointed ridges 40 (referred to in the patent as "thicker portions"). These pointed ridges are intended to engage the engine block 10 in load-bearing relationship as is evident from FIG. 3 and col. 2, lines 60–64 of the specification. This arcuate and "pointy" design has disadvantages as compared to "blunt" or predominately rectilinear ribs in two respects: limited heat exchange area and high mechanical stress. In respect of limited heat-exchange area, imagine two channels that are each one unit deep and two units wide. Imagine one channel is of a rectangular shape, and the other is semi-circular. Simple geometry establishes that, with respect to the total facial area of the sides and bottom of each channel, the facial area of the rectangular channel exceeds that of the semi-circular channel by more than 27%. In Eisenberg et al., this facial-area-reducing effect is not as large due the fact that the scallops are shallower than a full semi-circle, but the effect is nevertheless significant. In respect of high mechanical stress, mechanical loading between the ridge points and the engine block 10 is through line-contact or through very narrow regions of area contact, thereby subjecting the ridge points to high mechanical stress and the possibility of early failure.

In U.S. Pat. No. 5,299,538 to Kennedy et al. (Kennedy), the main portion of coolant flowing through the cylinder block reaches an outlet port directly and without diversion, but some of the coolant is diverted into the cylinder liner and then, after flowing within and absorbing heat from the liner, is sucked back out of the liner to rejoin the main portion of coolant flow in the vicinity of an outlet port for such main portion, providing what may be referred to as "coolant shunt flow" in the liner. The coolant shunt flow occurs through a single annular cooling channel 34. When the parts are assembled, engagement of the liner and cylinder block occurs at upper cylinder block engaging portion 26, whose top extremity is the stop shoulder 28, and whose bottom extremity is a an annular diameter-reduction shoulder (no reference number) formed in the liner wall, the outer diameter of the liner wall decreasing below such shoulder. The channel 34 extends in axial length (i.e. in width) approximately half way across the upper cylinder block engaging portion 26.

BRIEF DESCRIPTION OF THE INVENTION

With today's ever increasing demands for better performance and reliability, piston ring lubricating capabilities are being strained to the limits of lubricant quality and piston ring design in order to adequately protect the cylinder liner surface from scuffing and premature wear by the piston rings. There is a continuing need for improvements or alternatives to existing liner designs, including in particular those relating to cooling at the liner top.

The present invention embodies a novel coolant-shunt-flow flange type liner design capable of replacing prior shunt-flow flange type liners such as the liner 14 of Kennedy. The liner of the present invention can be used for example for liner replacement maintenance in a engine having a cylinder block or engine block identical to the cylinder block 10 shown in Kennedy.

According to the present invention, the new liner is provided with three annular cooling channels, each extending in axial length (i.e., in width) across substantially less than half the axial length (width) of the upper cylinder block engaging portion of the liner. The three cooling channels are partly defined by two ribs that are integral with the liner body and whose peaks are flat in profile. The channels are each generally rectilinear in cross section to increase facial area and thereby increase total heat exchange area. The array of cooling channels extends in axial length across a substantial majority, preferably 70% or more, of the axial length of the cylinder block engaging portion. The individual channels each extend across substantially less than half the length of such engaging portion. The flatness of the rib peaks provides area contact rather than linear contact with the cylinder block. The height of the ribs in the radial direction exceeds their width in the axial direction, preferably by 25% or more, to increase heat exchange area. At the same time, the rib cross-sections emulate short columns in resisting buckling loads, and thereby contribute robustly to mechanical support between the cylinder block and the cylinder liner at the upper cylinder block engaging portion of the liner.

The annular coolant shunt flow through the channels is multi-channel parrallel flow in both annular directions, favoring low flow resistance and greater through-put of coolant. Distribution into and collection from this parallel flow in both annular directions is accomplished in part by simple cutouts in the ribs.

DESCRIPTION OF THE DRAWINGS

For a better understanding of the invention, reference is made to the accompanying drawings, in which.

DETAILED DESCRIPTION OF THE INVENTION

Liners are located at points of high wear in the engine, and are intended to be replaced from time to time with new or rebuilt liners, in that respect reconditioning the engine for further efficient operation In order to provide a frame of reference for a more complete understanding of the present invention, a prior-art liner design and the operation of such liner in conjunction with an associated engine block will first be described in some detail. It will be understood that the engine block itself is generally intended to remain wholly or substantially unchanged in design after the liners are replaced, and this remains true in particular when the design of the replacement liner is changed from that of the original liner.

Figure 1:
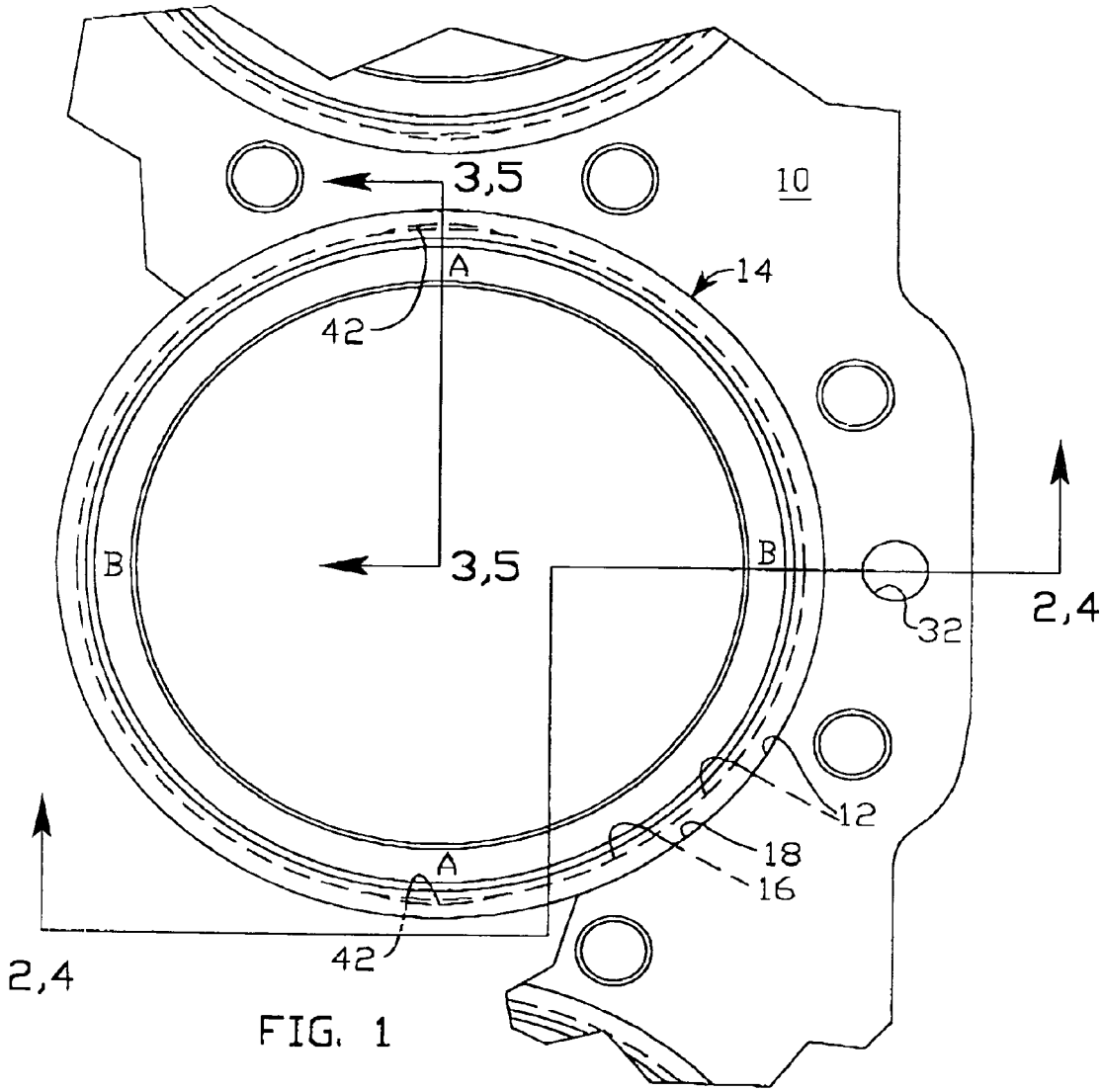
FIG. 1 is a broken-away plan view of part of an engine block 10, and also shows in plan a whole cylinder liner 14 and parts of adjacent cylinder liners, the liners being received in cylinder bores formed in the engine block. The engine block seen in FIG. 1 may be of a known design. The liners seen in FIG. 1 may also be of a certain known design, or they may embody the invention, since both the known design and a liner embodying the invention may be of identical appearance in plan view if, as is the case, certain hidden features are not included in the plan view.
Figure 2:
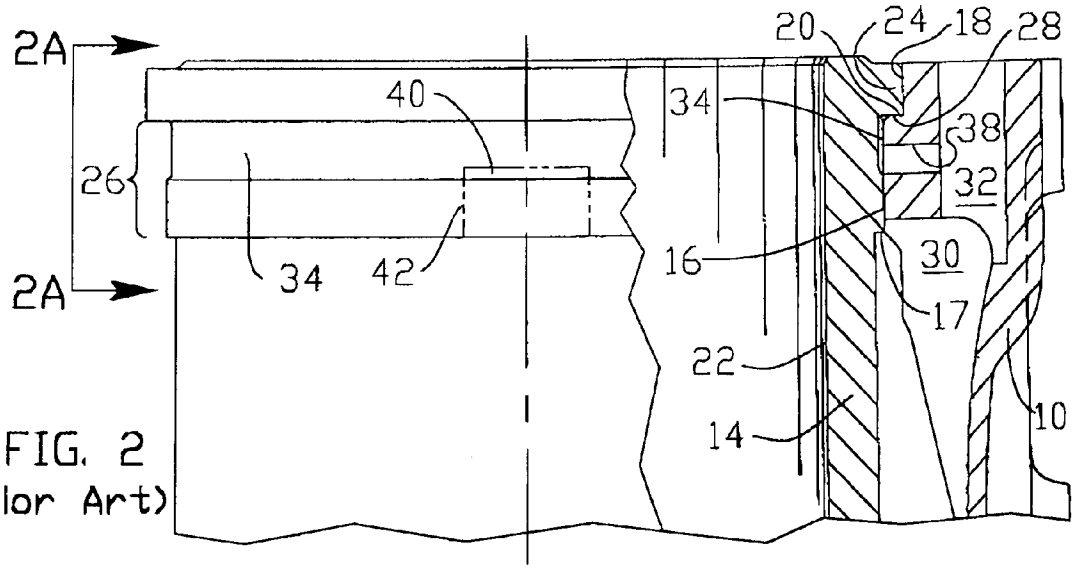
FIG. 2 (Prior Art)
FIG. 2 is a broken-away, partly cross-sectional, elevational view taken along line 2—2 in FIG. 1 and showing a known liner design in combination with the engine block.
Figure 3:
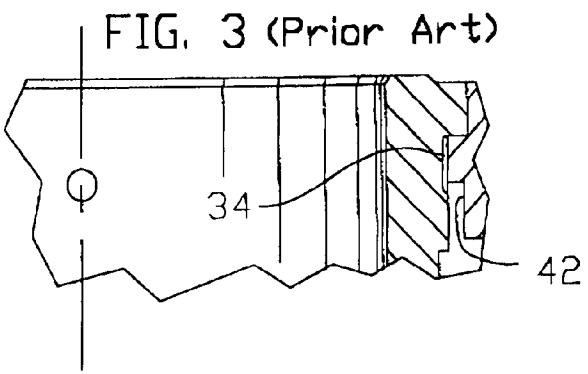
FIG. 3 (Prior Art)
FIG. 3 is a broken-away, partly cross-sectional, elevational view taken along line 3—3 in FIG. 1 and further showing, in combination with the engine block, the same known liner design.

In the prior-art liner-cylinder-block combination seen in FIGS. 2 and 3, and referring also to FIG. 1, each cylinder bore 12 in the cylinder block 10 receives a cylinder liner 14. Each cylinder bore 12 includes a main inner radial wall 16 of one diameter and an upper counterbore wall 18 of greater diameter so as to form a stop shoulder 20 at their juncture. In this particular prior-art example, the value of the main inner or internal cylinder bore diameter 16 is 149.0 mm.

Cylinder liner 14 includes a radial inner wall surface 22 of uniform diameter in which is received a reciprocating piston (fno).

Cylinder liner 14 further includes a radial flange 24 at its top end. This flange projects radially outwardly from an upper cylinder block engaging portion 26 of lesser diameter than the radial flange 24 so as to form a stop shoulder 28. The upper cylinder block engaging portion 26 extends downwardly from the stop shoulder 28 and terminates at its bottom end at an annular diameter-reduction shoulder 17 formed in the liner wall, the outer diameter of the liner wall decreasing below said shoulder. The shoulder 17 is shown as radial in profile, but may be tapered instead along a small or relatively great axial extent of the liner below the cylinder block engaging portion 26, and the term "annular diameter-reduction shoulder" is to be understood as including any of these alternatives. The entirety of the upper engaging portion 26 of the cylinder liner is closely fit with the cylinder block, the cylinder liner being secured in place in the cylinder head by the head bolt clamp in conventional manner.

Surrounding the greater portion of the cylinder liner is a coolant chamber 30 formed in the cylinder block. Coolant fluid is circulated within this chamber from an inlet port (not shown) and thence through one or more outlet ports 32.

As seen in FIGS. 2 and 3, a single circumferentially extending channel 34 is machined or otherwise formed in the radially outer wall of the upper engaging portion 26 of the cylinder liner. This channel has an axial extent or length beginning at the stop shoulder 28 and extending substantially half-way across the upper engaging portion 26, i.e. extending axially substantially half the distance between the stop shoulder 28 and the diameter-reduction shoulder 17.

Two diametrically opposed shunt inlet regions A (see FIG. 1) are associated with each cylinder liner for admitting coolant from the main coolant chamber 30 into the channel 34. Two diametrically opposed shunt outlet regions B are also associated with each cylinder liner for discharging fluid from the channel. Each outlet region is spaced 90 degrees around the liner circumference from each of the inlet regions. Incoming flow from the coolant chamber divides in two at each inlet region, then half of it travels an angular distance of 90 degrees through the channel 34 in one circumferential direction to one of the outlet regions B, and the other half travels in the opposite circumferential direction through the same angular distance to the other outlet region. Half the coolant discharged at each outlet region is from one of the inlet regions; the other half is from the other inlet region.

In the prior-art liner-cylinder block combination seen in FIGS. 2 and 3, a scallop 42 formed in the radially inner wall 16 of each cylinder is associated with each shunt inlet region A of each installed liner. The scallops extend in axial length sufficiently to overlap the axial extent of the channel 34. When the liner and cylinder block are assembled, each scallop extends the coolant chamber 30 whereby coolant fluid from the coolant chamber 30 is admitted from the chamber 30 directly into the channel 34 through inlet port 40, which is defined in part by the axially lower edge of channel 34 and in part by scallop 42, as seen in FIG. 2.

Each shunt outlet region B includes an outlet port 38 that is directly in register with the channel 34, and the outlet port therefore receives coolant directly from the channel. Each outlet port communicates with one of the outlet ports 32 of the main coolant chamber and interacts therewith as a venturi in which coolant is drawn or sucked from the outlet port by the stream of coolant emptying from the main coolant chamber.

Figure 3A:
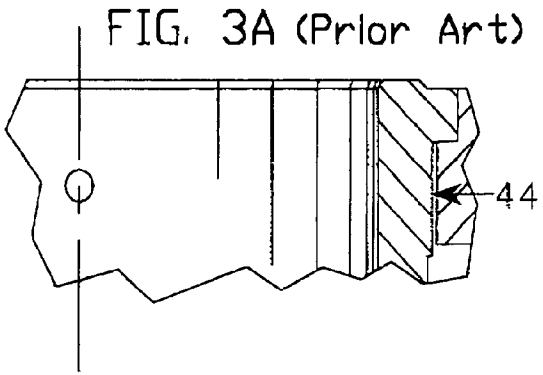
FIG. 3A (Prior Art)
FIG. 3A is similar to FIG. 3 and shows another known liner in combination with the engine block.

If the engine blocks do not have scallops formed therein, the same purpose of providing inlet ports through which a portion of coolant flow is admitted from the chamber 30 into the channel 34 may be accomplished by modifying the above-referred-to known design of liner, as has been proposed in the prior art, to provide another known design which the liner is the same in all respects as already described, with the exception that metal is not removed from the engine block by scalloping, but rather is removed from the body of the cylinder liner 14 by a chordal cut 44, as seen in FIG. 3A. (The cut 44 is chordal in the sense that the radially inner face of the cut is generated by a chord of the imaginary circle that generates the cylindrical, radially outer face of the engaging portion 26.) When the liner and engine block are assembled, the cut 44 establishes an extension of the coolant chamber 30 whereby coolant fluid from the chamber 30 is admitted from the chamber 30 directly into the channel 34.

Figure 2A:
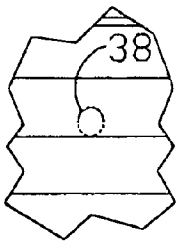
FIG. 2A (Prior Art)
FIG. 2A is a fragmentary elevational view taken along line 2A—2A of FIG. 2.
Figure 4:
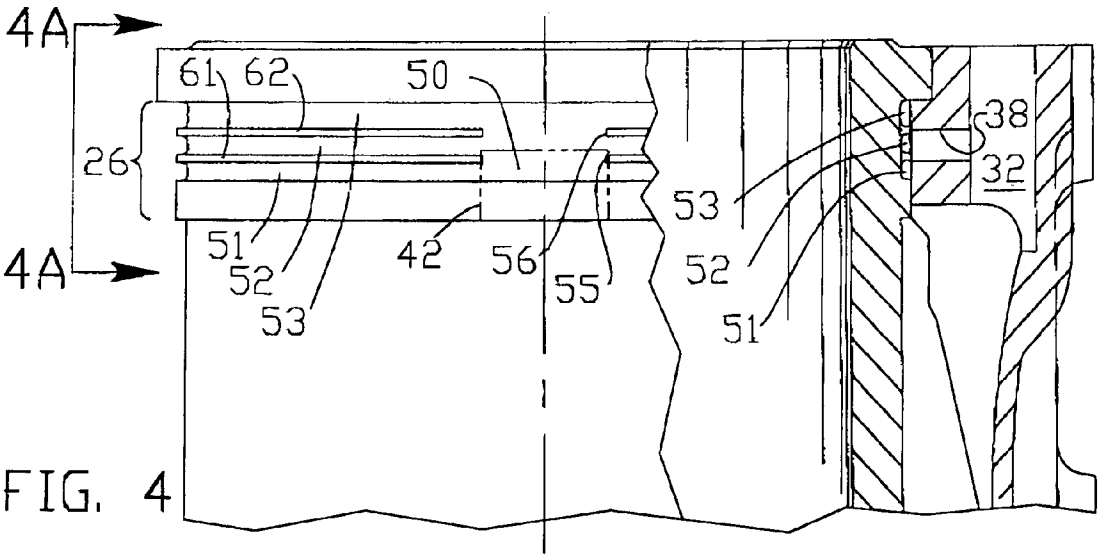
FIG. 4 is a broken-away, partly cross-sectional, elevational view taken along line 4—4 in FIG. 1 and showing, in combination with an engine block, a liner design that embodies the invention.
Figure 4A:
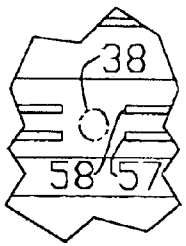
FIG. 4A is a fragmentary elevational view taken along line 4A—4A of FIG. 4.
Figure 5:
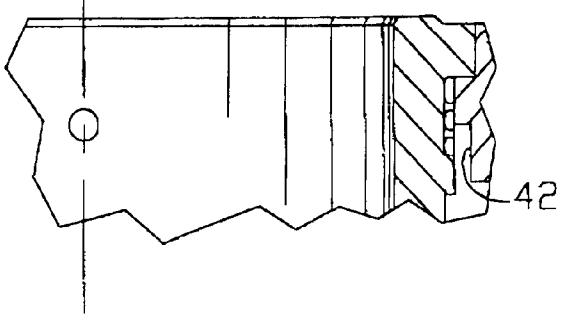
FIG. 5 is a broken-away, partly cross-sectional, elevational view taken along line 5—5 in FIG. 1 and further showing, in combination with the engine block, the same liner design embodying the invention that is shown in FIG. 4.

The present invention provides a new design of shunt-flow flange type liner capable of replacing liners of the prior art, such as those described above. An embodiment is illustrated in FIGS. 4, 4A and 5. Many of the elements of such embodiment are similar to those of the prior-art liner shown in FIGS. 2, 2A and 3, and in the following description will be labeled with the same reference numbers used in describing such prior-art liner.

The design of the invention replaces the single channel 34 of the prior art with an array of three annular cooling channels 51, 52 and 53, each extending in axial length across substantially less than half the length of the cylinder block engaging portion 26 of the liner, but together as an array extending in axial length across a substantial majority, preferably 70% or more, of the cylinder block engaging portion 26. The invention embodies the insight that, with proper proportioning of such an array and the ribs that form it as set forth herein, improved heat exchange area and improved flow area can be accomplished, as compared to a single channel such as the channel 34 of the prior art.

The three cooling channels are partly defined by two ribs 61 and 62 that are integral with the liner body and whose peaks are flat in profile, thereby providing area contact with the cylinder block wall 16. As previously indicated, the height of these ribs in the radial direction exceeds their width in the axial direction, preferably by about 25% or more, to increase heat exchange area from what it would be with lower radial-to-axial dimensions.

When the liner and a cylinder block are assembled, each scallop 42 establishes an extension of the chamber 30 whereby, in this embodiment of the invention, coolant fluid from the coolant chamber 30 is admitted from chamber 30 directly into annular cooling channel 51 through inlet port 50, which is defined in part by the axially lower edge of channel 51 and in part by scallop 42, as seen in FIG. 4.

To adequately feed channel 52, some of the incoming coolant must first enter at the inlet port 50 and then traverse from channel 51 to channel 52. To adequately feed channel 53, some of the incoming coolant must first enter the inlet port 50 and then traverse from either channel 51 or 52 to channel 53. The present invention embodies the further insight that provision of aligned cutouts in the ribs at the shunt inlet regions A of the liner can simply and effectively provide flow paths to meet these requirements. Suitable cutouts 55 and 56 are provided as shown in FIG. 4, thereby accommodating transverse flow and even distribution of incoming coolant among the three channels. The cutouts preferably have about the same circumferential extent as the inlet port 50, as shown.

Additional cutouts 57 and 58 located at the shunt outlet regions B are also provided, as illustrated in FIG. 4A. In some instances, when one rib is centered or almost centered on the outlet port 38, and perhaps outward flaring (not shown) of the upstream end of outlet port 38 is also provided, the cutout associated with the rib that is so centered may be eliminated, thus picking up some heat exchange area.

Figure 5A:
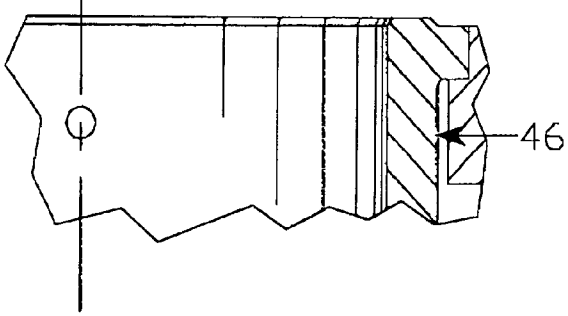
FIG. 5A is a view similar to FIG. 5 and shows another liner design that embodies the invention, in combination with an engine block.

If the engine blocks do not have scallops formed therein, the purpose of providing circumferentially aligned cutouts and thereby accommodating transverse flow and even distribution of incoming coolant among the three channels may be accomplished by using a chordal cut 46 as shown in FIG. 5A, similar to the chordal cut 44 of the prior art as seen in FIG. 3A, but in which the chordal cut 46 removes parts of the ribs 61 and 62, that is, removes all rib metal that was radially outward of cut 46, thereby providing circumferentialy aligned cutouts in ribs 61 and 62. (Such parts of the ribs, having been removed by the making of the cut 46, are not seen in FIG. 5A). When the liner and engine block are assembled, the chordal cut 46 establishes an extension of the chamber 30 as well as forming the circumferentially aligned cutouts.

For guidance in proper rotational positioning of the liner 14 as it is being assembled in the engine block in the constructions of FIGS. 4, 4A, 5 and 5A, the top face of the liner may be marked with a radial indicator line (not shown) located directly above the center of a cutout 58 that is associated with one of the shunt outlet regions B. During assembly, the rotational position of the liner will be known to be correct when this indicator line points to the center of either one of the outlet ports 32.

The invention is not intended to be limited to the details of the above disclosure, which are given by way of example and not by way of limitation. Many refinements, changes and additions to the invention may be made without departing from the scope of the following claims as properly interpreted.

What is claimed is:

1. A coolant-shunt-providing cylinder liner of the flanged type receivable and securable in a cylinder bore of a cylinder block of an internal combustion engine, said liner having a radial flange at the top end of said cylinder liner and positionable adjacent the combustion chamber of the engine, said liner having a cylinder block engagement portion immediately below said radial flange, said radial flange including a circumferentially extending stop shoulder at the junction between the radial flange and said cylinder block engagement portion, the lower end of said cylinder block engagement portion terminating at an annular diameter-reduction shoulder formed in the liner wall, the cylinder liner being capable of being supported and held within the cylinder block throughout the axial extent of said radial flange and said cylinder block engagement portion taken together, an array of three annular cooling channels each formed in the wall of said liner and each extending circumferentially around said liner and each extending in axial length within, and across substantially less than half of, the axial length of the upper cylinder block engaging portion of the liner, said array of cooling channels extending in axial length within, and across a substantial majority of, the axial length of the cylinder block engaging portion, said three cooling channels being partly defined by two ribs, said ribs extending circumferentially around said liner and being integral with the body of the liner, the peaks of said ribs being flat in profile and adapted for area contact with the cylinder block, said channels forming passages for coolant shunt flow in both circumferential directions, said flow being parallel in nature in both circumferential directions, two diametrically opposed shunt inlet regions associated with said liner and at each of which coolant is admitted from a coolant chamber to said array of cooling channels, two diametrically opposed shunt outlet regions associated with said liner and at each of which there is a collection passage arrangement whereby coolant is collected and emptied from said array of cooling channels, each of said shunt outlet regions being spaced around the liner circumference an angular distance of 90 degrees from both said shunt inlet regions, circumferentially aligned cutouts in said two ribs at each of said shunt inlet regions, and a cutout in at least one of said two ribs at each of said shunt outlet regions.

2. A cylinder liner as in claim 1, said collection passage arrangements including circumferentially aligned cutouts in both said ribs at each of said shunt outlet regions.

3. A cylinder liner as in claim 1, said array of cooling channels extending in axial length across at least 70% of the axial length of said cylinder block engaging portion.

4. A cylinder liner as in claim 3, the height of said ribs in the radial direction exceeding their width in the axial direction by at least 25%.

* * * * *